US011428063B1

(12) United States Patent
Strankman

(10) Patent No.: US 11,428,063 B1
(45) Date of Patent: Aug. 30, 2022

(54) PACK-OFF ASSEMBLY FOR WIRELINE PRESSURE-CONTROL OPERATIONS

(71) Applicant: Lee Specialties Inc., Blackfalds (CA)

(72) Inventor: Daine Strankman, Red Deer (CA)

(73) Assignee: Lee Specialties Inc., Blackfalds (CA)

( * ) Notice: Subject to any disclaimer, the term of this patent is extended or adjusted under 35 U.S.C. 154(b) by 0 days.

(21) Appl. No.: 17/321,069

(22) Filed: May 14, 2021

(51) Int. Cl.
*E21B 33/072* (2006.01)
*E21B 17/02* (2006.01)

(52) U.S. Cl.
CPC ..... *E21B 33/072* (2013.01); *E21B 17/025* (2013.01)

(58) Field of Classification Search
CPC ..... E21B 33/072; E21B 17/025
See application file for complete search history.

(56) References Cited

U.S. PATENT DOCUMENTS 8,875,798 B2 * 11/2014 Van Winkle ..... E21B 33/076 166/387

* cited by examiner

*Primary Examiner* — Jonathan Malikasim
(74) *Attorney, Agent, or Firm* — D. Tiller Law PLLC; Donald Tiller

(57) ABSTRACT

The described pack-off assembly includes a tubular sleeve that is configured to selectively encompass a pack-off wireline seal and that is positionable through selective application of pressurized fluid to one or more actuation chambers that interact with a piston portion of the sleeve. Pressure may be applied to position the sleeve to encompass the seal to engage a wireline and enable pressure-control wireline operations. A different pressure may be applied to position the sleeve to expose the seal for servicing.

14 Claims, 7 Drawing Sheets

A-A

A-A

PACK-OFF ASSEMBLY FOR WIRELINE PRESSURE-CONTROL OPERATIONS

BACKGROUND

This invention pertains generally to pressure-control equipment used, for example, in operations on oil/gas wells. More specifically, the invention is directed to technology for an improved pack-off assembly (variously also referred to in the art as a "stripper," "stuffing box," "pack-off," or "pack off").

SUMMARY

In one aspect of the invention, a pack-off assembly includes a positionable sleeve that includes a piston portion and tubular cavity. The piston portion of the sleeve is disposed in a tubular cavity of a support element and thereby defines two chambers bounded by the sleeve and the support element. The chambers are ported for application of pressurized fluids such as air or hydraulic oil. Application of pressurized fluids to one or both of the activation chambers can yield a pressure differential across the piston, causing the piston (and the sleeve) to move within the support element's cavity. The sleeve's tubular cavity is suitable for containing sealing elements to seal around a wireline. Selective application (addition or removal) of pressurized fluids in the actuation chambers positions the sleeve such as to selectively contain the sealing elements (a "closed" position for pressure-control operations) or expose the sealing elements (an "open" position for access to the sealing elements). The pack-off may further include a latch that is positionable to engage a feature of the sleeve and thereby lock the sleeve in a closed position. The wireline sealing element may be divided into multiple sections to allow assembly of the sealing element around the wireline. Multiple-section support bushings may be provided adjacent to the sealing element. Dowel pins may be disposed in mating sections of the support bushings or in mating sections of the sealing element in order to constrain relative motion of the sections (e.g., to keep them properly aligned with each other). The pack-off may further include a wireline entry guide to protect the wireline during operations. For example wireline entry guide may include rollers configured to engage the wireline during operations and protect against, for example, abrasion of the wireline or the pack-off. The pack-off may be stackable with other pack-off of the same kind.

In another aspect of the invention, a method of controlling pressure during wireline operations includes providing a pack-off assembly having a positionable sleeve and a wireline sealing element disposed within the sleeve, and applying a pressurized fluid to an actuation chamber to selectively position the sleeve such that it moves away from the sealing element so that the sealing element is no longer within the sleeve (allowing, e.g., an operator to access the sealing element). A pressurized fluid may be applied to another actuation chamber to position the sleeve such that the sealing element is disposed within the sleeve. In other words, pressurized fluids may be selectively applied to actuation chambers of the pack-off assembly to position the sleeve in a closed position, in which the sealing element is enclosed by the sleeve and the pack-off assembly is ready for pressure-control operations, or in an open position, in which the sealing element is exposed (e.g., for maintenance).

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
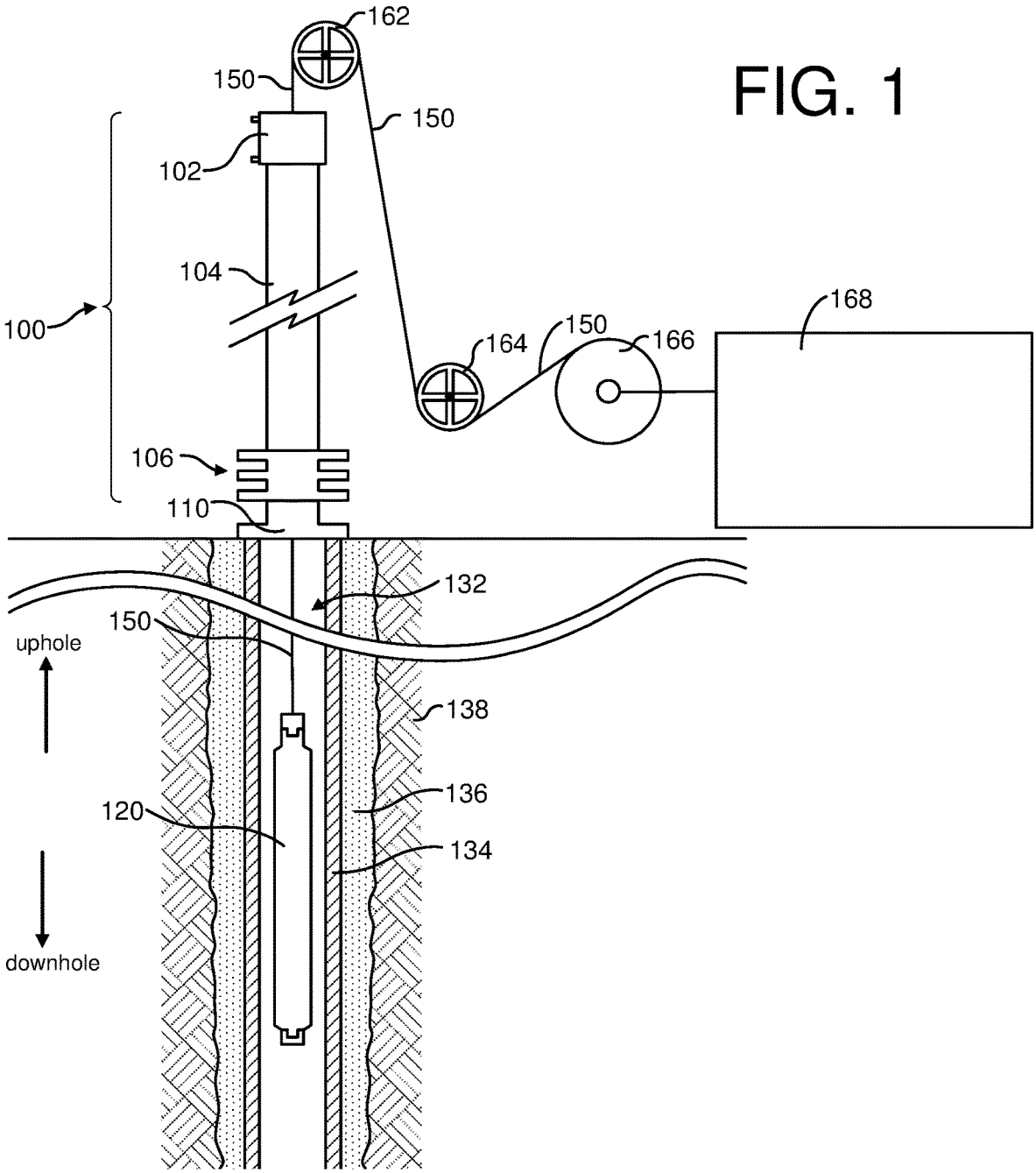
FIG. 1 illustrates pressure-control equipment attached to the wellhead of a well with a tool deployed in the wellbore on a wireline.

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts. Unless expressly set forth as an essential feature of the invention, a feature of a particular embodiment should not be read into the claims unless expressly recited in a claim.

Except as explicitly defined otherwise, the words and phrases used herein, including terms used in the claims, carry the same meaning they carry to one of ordinary skill in the art as ordinarily used in the art.

Because one of ordinary skill in the art may best understand the structure of the invention by the function of various structural features of the invention, certain structural features may be explained or claimed with reference to the function of a feature. Unless used in the context of describing or claiming a particular inventive function (e.g., a process), reference to the function of a structural feature refers to the capability of the structural feature, not to an instance of use of the invention.

Except for claims that include language introducing a function with "means for" or "step for," the claims are not recited in so-called means-plus-function or step-plus-function format governed by 35 U.S.C. § 112(f). Claims that include the "means for [function]" language but also recite the structure for performing the function are not means-plus-function claims governed by § 112(f). Claims that include the "step for [function]" language but also recite an act for performing the function are not step-plus-function claims governed by § 112(f).

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Terms of degree, such as "substantially," "about," and "roughly" are used herein to denote features that satisfy their technological purpose equivalently to a feature that is "exact." For example, a component A is "substantially" perpendicular to a second component B if A and B are at an angle such as to equivalently satisfy the technological purpose of A being perpendicular to B.

Except as otherwise stated herein, or as is otherwise clear from context, the term "or" is used herein in its inclusive sense. For example, "A or B" means "A or B, or both A and B."

FIG. 1 depicts an exemplary wireline operation involving pressure-control equipment. A tool 120 (e.g., plug setting tool, perforating gun, logging tool) is placed into a wellbore 132. In this example, the wellbore 132 is cased with casing 134 which is connected to the geological formation 138 with cement 136. The tool 120 is connected to a surface control system 168 through a wireline 150. Pressure-control equipment 100 connected to a wellhead 110 is used to keep fluids in the borehole 132 from exiting the borehole 132 due to a pressure differential between the borehole and the surface. The wireline 150 is run from a winch 166, connected to the surface control system 168, under a lower sheave 164, over an upper sheave 162, and through the pressure-control equipment 100.

In this example, the pressure-control equipment stack (PCE stack) 100 includes a wireline valve 106, a series of lubricator sections 104, and a pack-off assembly 102. In preparation for the downhole operation, the wireline is typically placed through one or more seals in the pack-off assembly 102, through the lubricator 104 (and other pressure-control equipment in the stack), and through the wireline valve 106, where it is then connected to the tool 150. The tool 120 is then placed in the lubricator 104 and the PCE stack 100, with the tool 120 within, is hoisted by a crane and attached to the wellhead 110. The seals in the PCE stack 100 are tested to pressure, and, if they pass, the wellhead is opened to allow the tool to be positioned in the wellbore 132 and the PCE stack maintains the pressurized wellbore fluids within the wellbore 132.

The sealing elements in the pack-off assembly 102 experience wear and tear and often need to be replaced to ensure proper pressure containment. Typically, replacement of the seals (and related components) requires disassembling the PCE stack 100 or cutting the wireline 150. This is a time-consuming, costly, error-prone process. The present invention enables quick replacement of the seals without disassembling the PCE stack 100 or cutting the wireline 150.

Figure 2A:
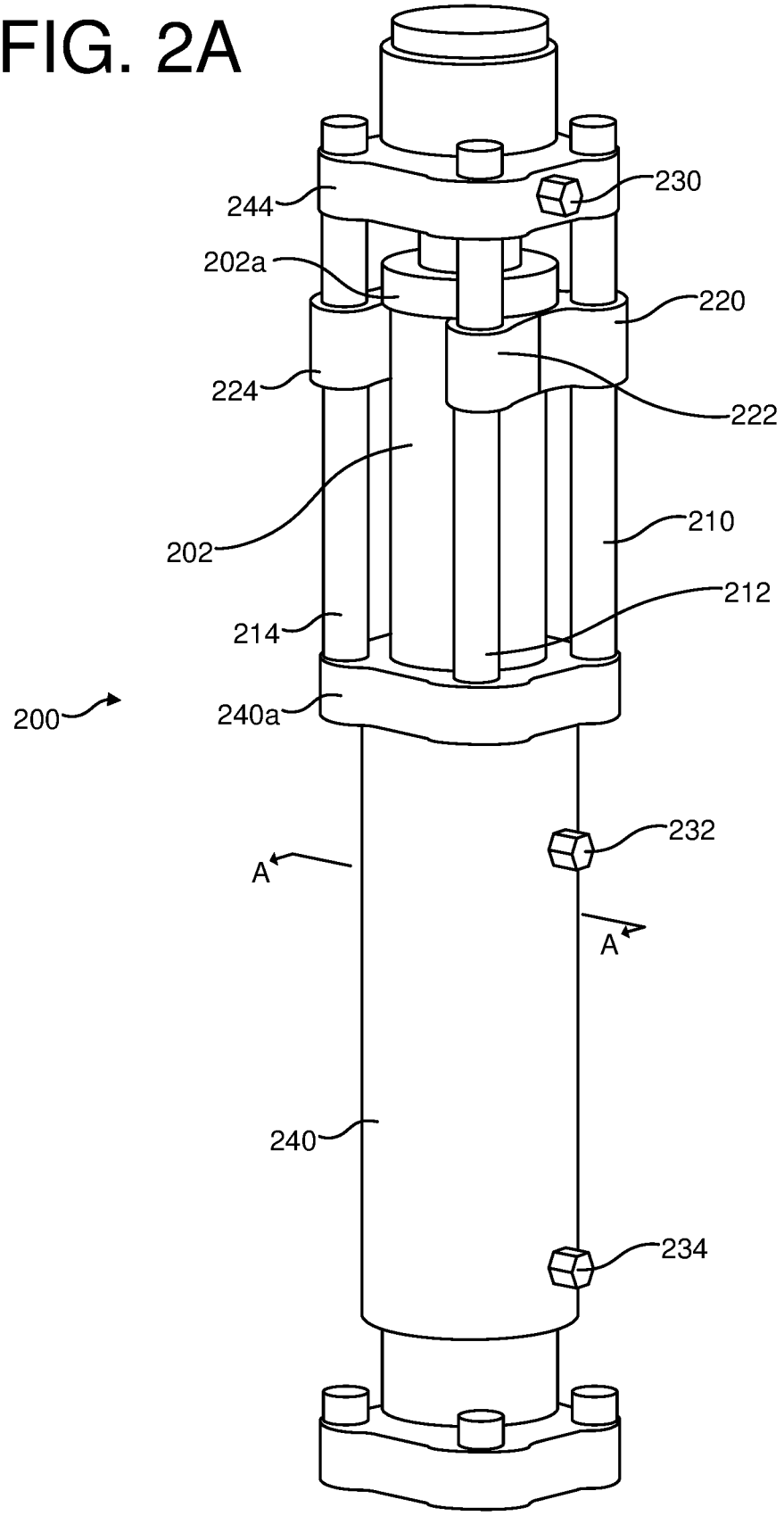
FIGS. 2A-2C depict various views of an exemplary pack-off assembly according to an aspect of the invention.
Figure 2B:
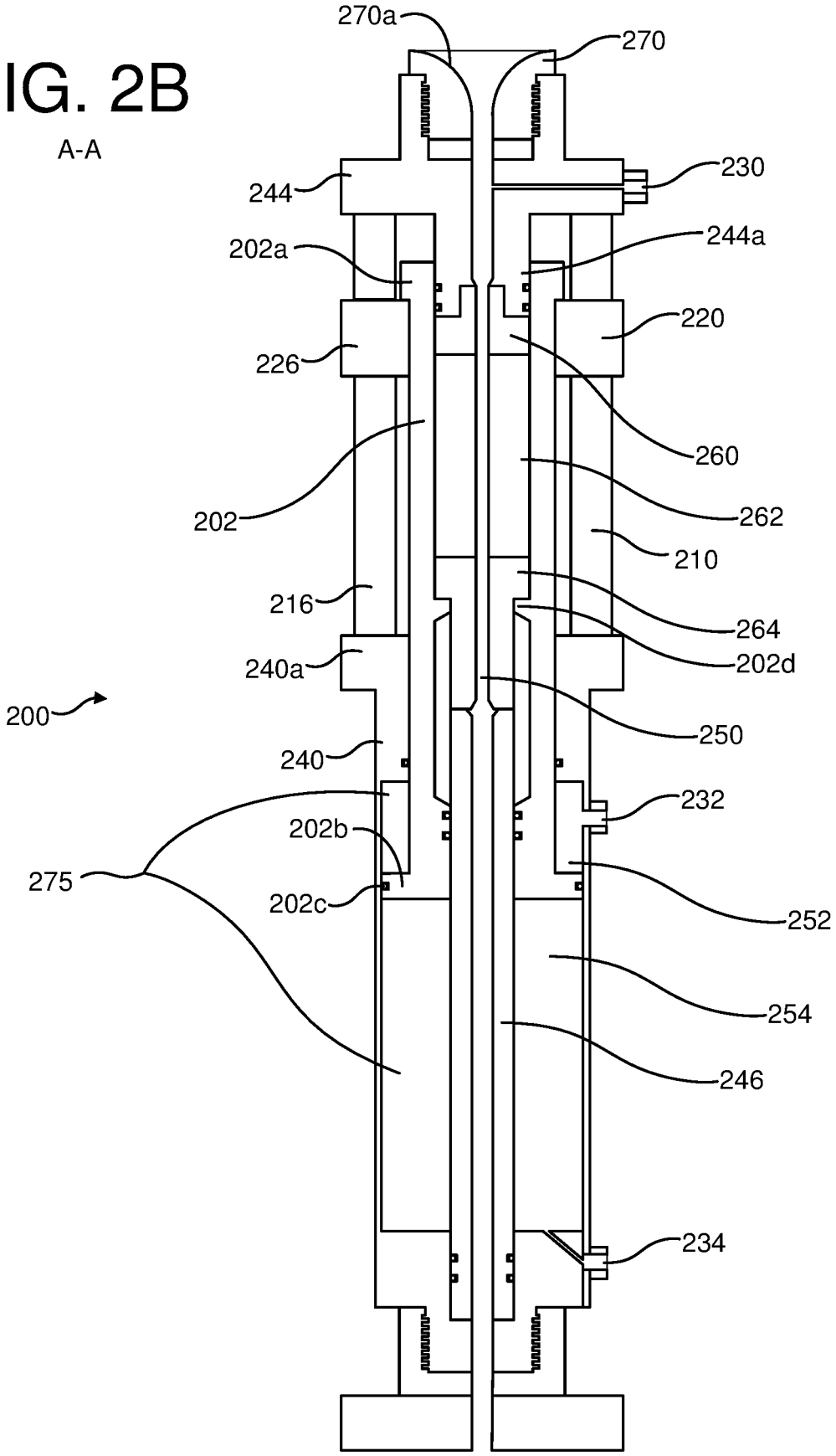
Figure 2C:
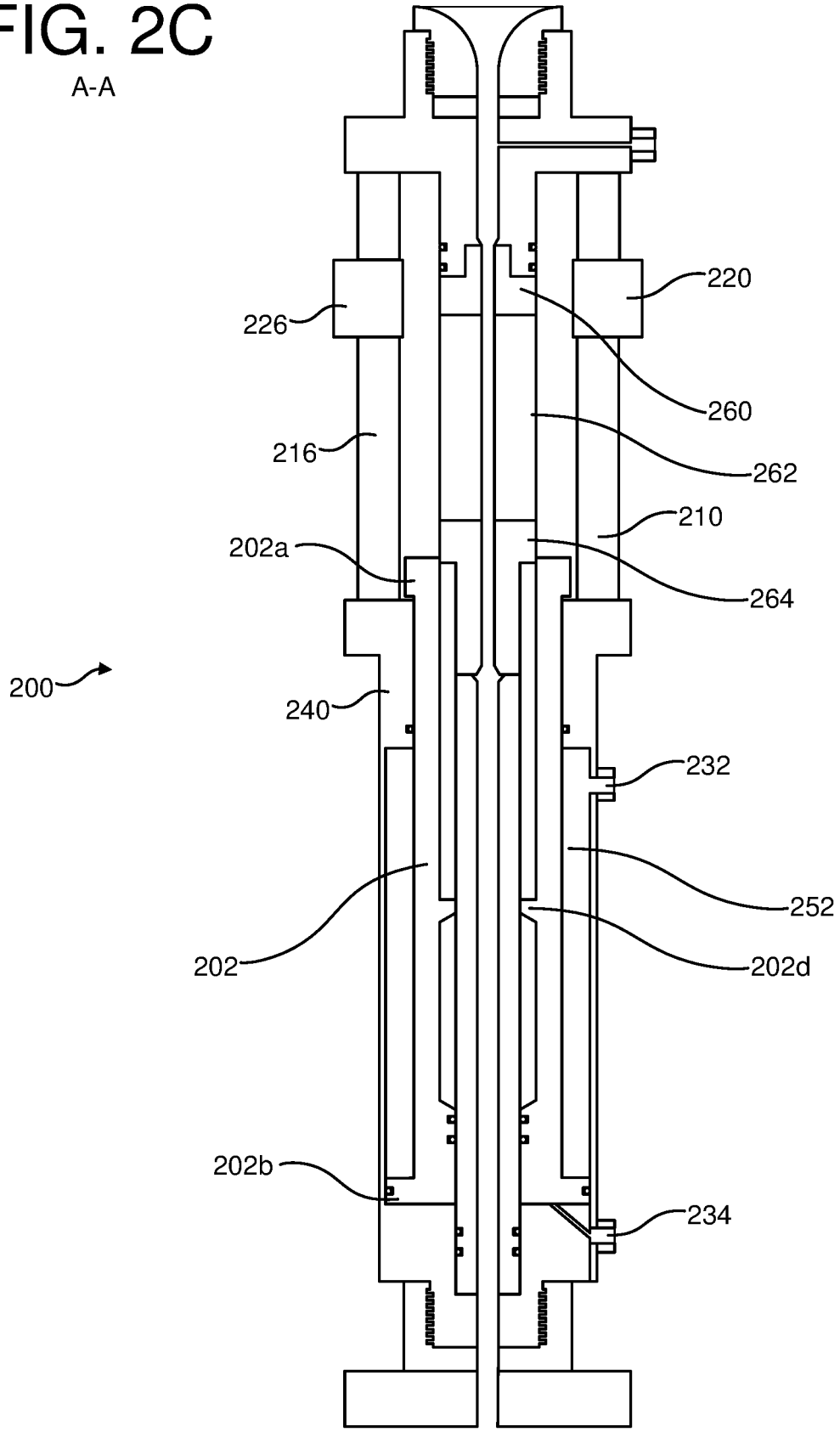

FIGS. 2A-2C depict various views of an exemplary pack-off assembly 200 with a retractable side-door sleeve 202 according to an aspect of the invention. FIG. 2A is a perspective view of the pack-off assembly 200. FIGS. 2B and 2C are side section views of section A-A, with FIG. 2B showing the pack-off 200 with the side-door sleeve 202 in the extended (or "closed") position (as in FIG. 2A) and FIG. 2C showing the pack-off 200 with the side-door sleeve 202 in the retracted (or "open") position.

The side-door sleeve 202 has an upper rib portion 202*a* configured to engage selectively positionable latches 220, 222, 224, 226 when the side door 202 is in its extended position. The latches 220, 222, 224, 226 are each pivotably mounted to a separate support rod 210, 212, 214, 216 which connects an upper support assembly 244 to a lower support assembly 240. The side-door sleeve 202 is roughly tubular, having a tubular cavity configured to encompass a wireline sealing element 262 and support bushings 260, 264. The tubular cavity of the side-door sleeve 202 is further configured to accept an upper support pin 244*a* (shown here as an integral part of the upper support assembly 244, but it may equivalently be a separate component attached to the upper support assembly 244) and a lower wireline-channel pin 246 (shown here as a component attached to the lower support assembly 240, but it may equivalently be integral to the lower support assembly 240). In operation the sealing element 262 and bushings 260, 264 are placed within the tubular cavity of the side-door sleeve 202 (in its extended, or closed, position), sandwiched between the upper support pin 244*a* and the lower wireline-channel pin 246, and the wireline is run through a tubular channel 250 extending the entire length of the pack-off 200. The lower wireline-channel pin 246 in this embodiment serves primarily to provide a wireline channel 250 through the pack-off assembly 200. The lower support bushing 264 is supported by a rib 202*d* on the side-door sleeve 202. When the sleeve 202 is in its extended or closed position, the rib 202*d* engages the lower support bushing 264 and provides an axial compressive force on the sealing element 262 to effect a seal around a wireline disposed in the wireline channel 250.

Figure 3:
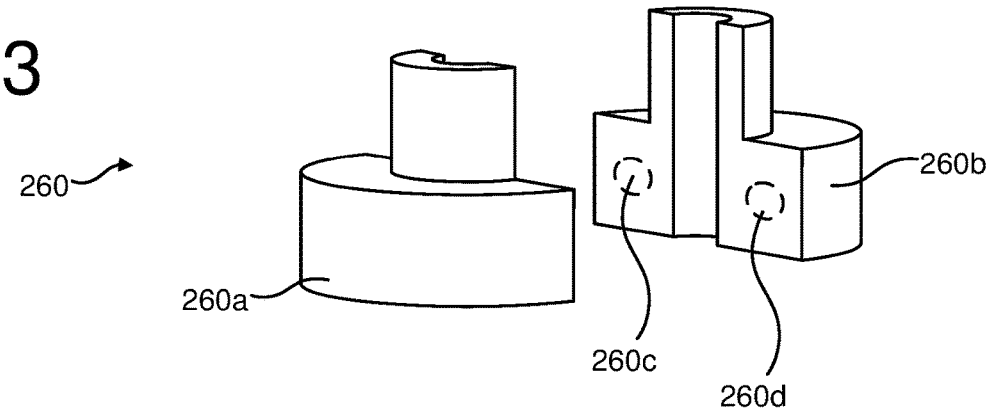
FIG. 3 depicts an exemplary replaceable two-part pack-off support bushing according to an aspect of the invention.
Figure 4:
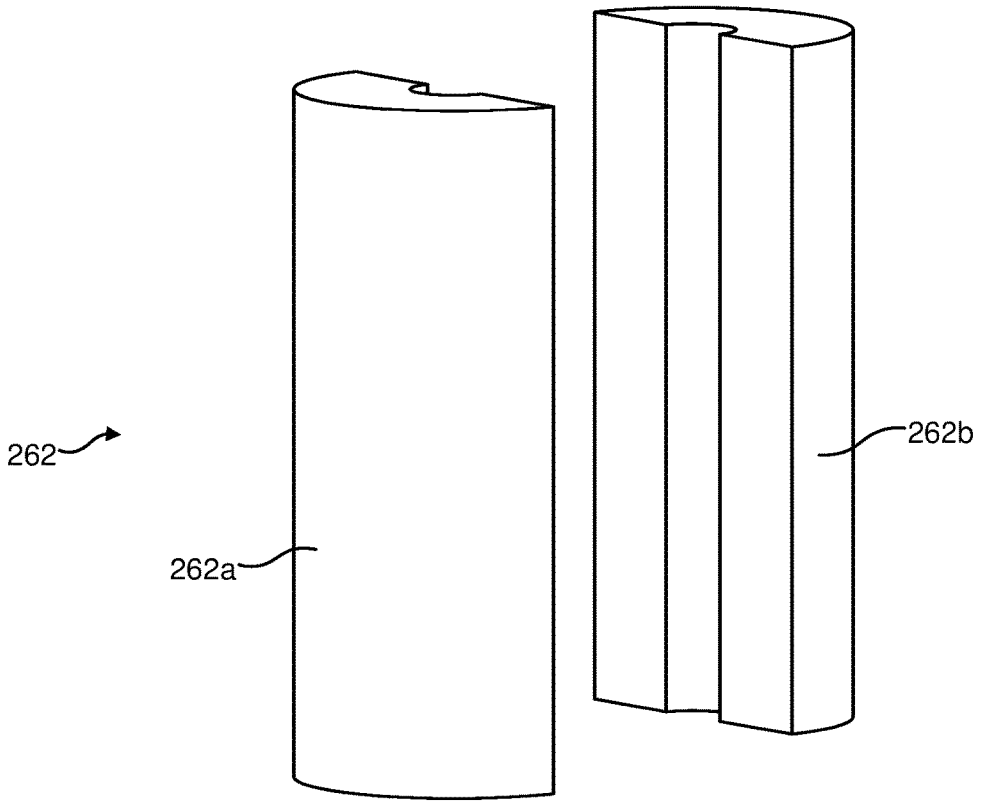
FIG. 4 depicts an exemplary replaceable two-part pack-off sealing element according to an aspect of the invention.
Figure 5:
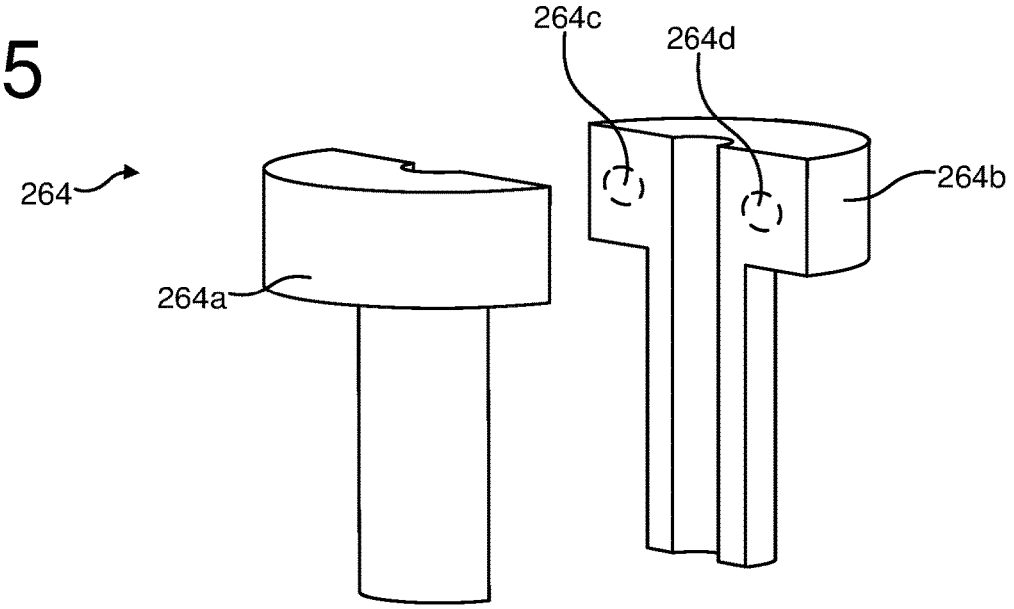
FIG. 5 depicts an exemplary replaceable two-part pack-off support bushing according to an aspect of the invention.

The pack-off wireline sealing element 262 and support bushings 260, 264 are each multi-part such that they can be assembled around a wireline (as opposed to a single-part seal or bushing through which the wireline must be fed). In the exemplary embodiments of FIGS. 3-5, each is a two-part component configured to fit around the wireline. FIG. 3 depicts a perspective exploded view of an upper bushing 260 (which may be made with a wear-resistant material such as nylon or brass) with two halves 260*a*, 260*b*. FIG. 4 depicts a perspective exploded view of a seal 262 (which may be made with compressible material such polyurethane or rubber) with two haves 262*a*, 262*b*. FIG. 5 depicts a perspective exploded view of a lower bushing 264 (which may be made with a wear-resistant material such as nylon or brass) with two halves 264*a*, 264*b*. The support bushing sections 260*a*, 260*b*, 264*a*, 264*b* may include holes 260*c*, 260*d*, 264*c*, 264*d* configured to receive dowel pins used to maintain the alignment of the sections as they are assembled. The sealing element sections may include similar holes to receive dowel pins for the same purpose.

The side-door sleeve 202 of the pack-off assembly 200 is further configured with a piston portion 202*b* deployed in a tubular cavity 275 of the lower support assembly 240. The piston 202*b* in the cavity 275 defines two actuation chambers 252, 254. The piston 202*b* engages the wall of the cavity to form a seal with, e.g., an O-ring 202*c*. (In FIGS. 2B and 2C O-ring seals are shown disposed on various parts, including the piston, but not all are labeled or itemized.) The upper chamber 252 is used to move the side door 202 down (to an "open" position) and thereby enable access to the bushings 260, 264 and sealing element 262. This open actuation is accomplished through supply of a pressurized fluid via port 232 to generate a pressure in the upper chamber 252 that is sufficient to overcome the pressure in the lower chamber 254. The open actuation may further include releasing pressure from the lower chamber 254 by, e.g., removing pressurized fluid from the lower chamber 254. The lower chamber 254 is used to move the side door 202 up (to a "closed" position) and thereby secure the seal 262 against the wireline to enable pressure-control operations. This close actuation is accomplished through supply of a pressurized fluid via port 234 to generate a pressure in lower chamber 254 that is sufficient to overcome the pressure in the upper chamber 252. The open actuation may further include releasing pressure from the upper chamber 252 by, e.g., removing pressurized fluid from the upper chamber 252. The pressurized fluid may be hydraulic or pneumatic. For example, in one embodiment, pressurized air (or nitrogen or other gas) is provided to the upper chamber 252 and pressurized oil (or water or other liquid) is provided to the lower chamber 254.

The pack-off assembly 200 may further include a lubrication port 230, through which wireline lubricant may be added for use with a coated wireline. (In an alternative embodiment, the assembly may include a grease port to allow pressurized grease to flow into the wireline channel to effect a seal around an uncoated wireline.)

Figure 6:
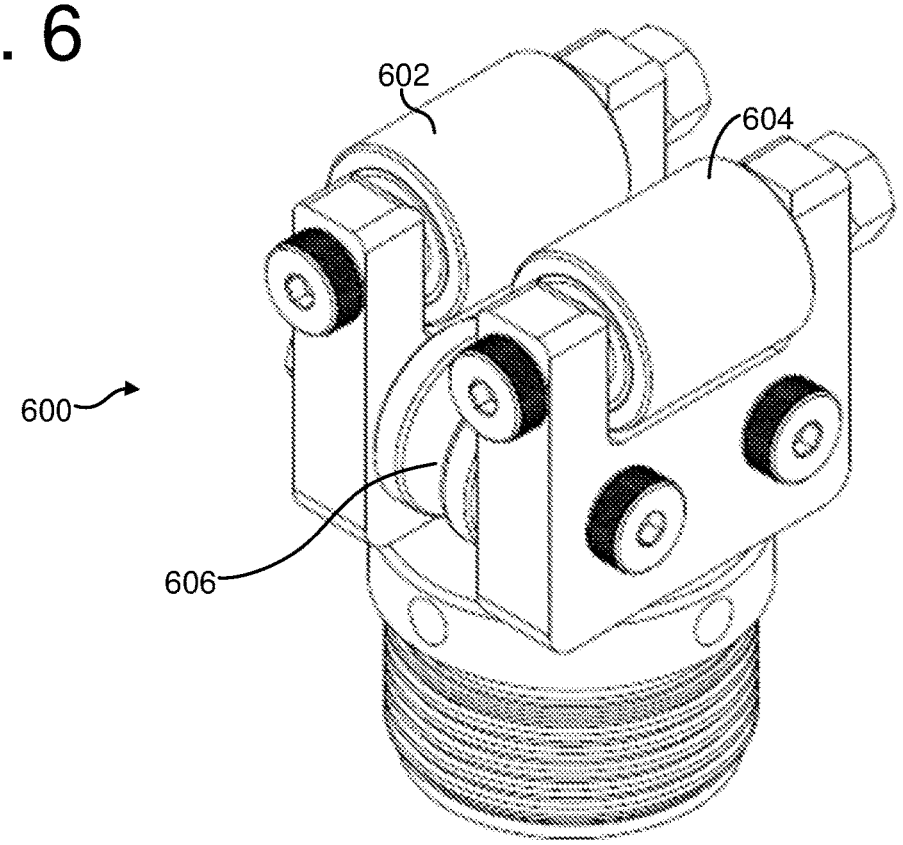
FIG. 6 depicts an exemplary wireline entry guide according to an aspect of the invention.

The pack-off assembly 200 may further include a wireline entry guide 270 connected to the upper support assembly 244, which provides a sloped inner surface 270*a* to protect the wireline during operations. An alternative wireline entry guide 600 is depicted in FIG. 6. The alternative guide includes rollers to protect the wireline during operation. For example, the exemplary guide 600 includes four rollers (one hidden in the figure): a pair of upper rollers 602, 604 and a pair of lower rollers 606 (one unseen) that is 90-degrees offset to the upper pair.

Figure 7A:
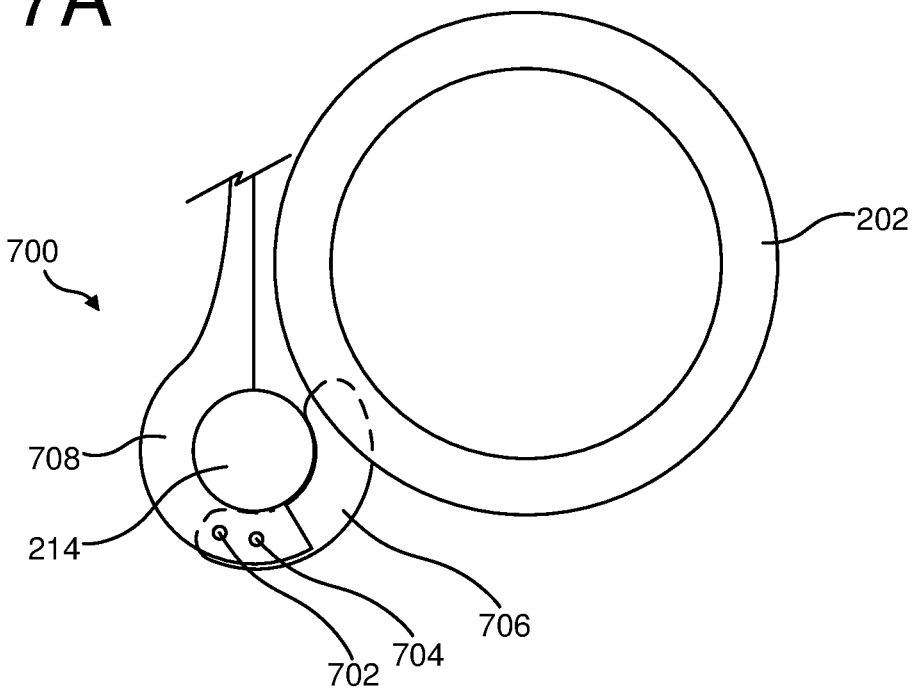
FIGS. 7A-7B depicts an exemplary side-door-sleeve latch according to an aspect of the invention.
Figure 7B:
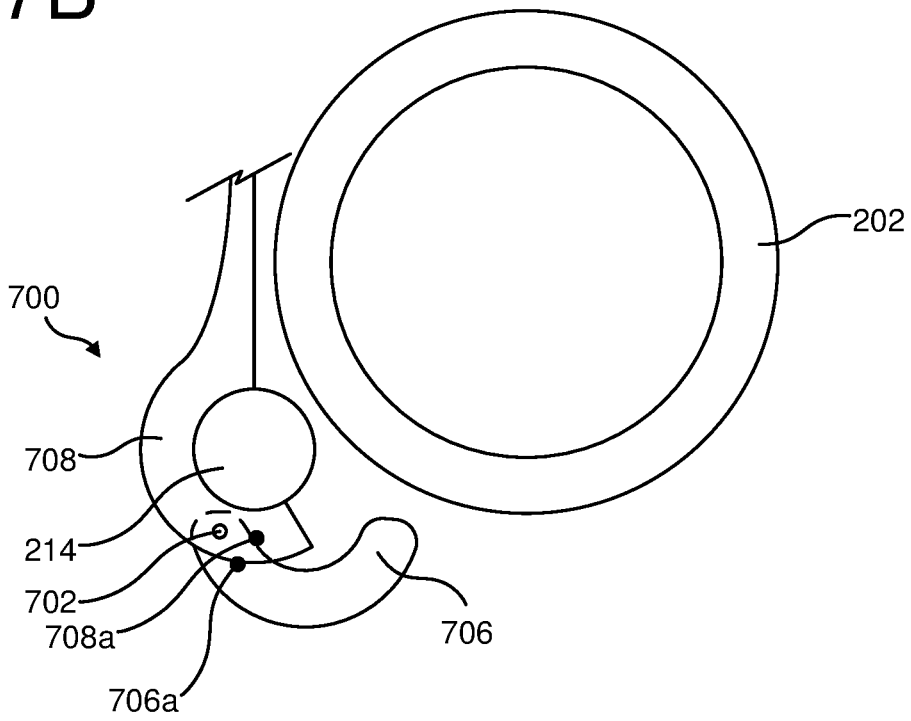

An exemplary alternative latch assembly 700 is depicted in FIGS. 7A-7B, which are top views of the latch assembly disposed on a support rod 214 next to a side-door sleeve 202. FIG. 7A depicts the latch 700 engaged with the side-door sleeve 202. FIG. 7B depicts the latch 700 disengaged from the side-door sleeve 202. The latch assembly 700 includes: (1) a support component 708 secured to the support rod 214 (the support component 708 potentially is also secured to another latch assembly on another support rod, not shown), (2) a pivoting component 706 pivotably secured to the support component 708, (3) a pivot pin 702, pivotably securing the pivoting component 706 to the support component 708, and (4) a lock pin 704 that, when placed in a hole 706*a* of the pivoting component 706 and a corresponding hole 708*a* of the support component, keeps the pivoting component from pivoting, thus securing the latch in the latched position. In operation, when the latch 700 is to be disengaged to enable retraction of the side-door sleeve 202 to enable an operator to service the seal or bushings, the lock pin 706 is removed. To prepare the pack-off assembly for pressure-control operations, the latch 700 is engaged with the side-door sleeve 202 and the lock pin 704 is inserted into the two corresponding holes 706*a*, 708*a*, to secure against inadvertent disengagement of the latch. While the described exemplary latches engage the sleeve through a rotational motion, they can also be implemented with a translational component. For example, a latching assembly may include a sliding shaft and a support component configured to constrain the shaft except for translational motion toward and away from the sleeve (e.g., a sliding bolt fit into a hole of the support component).

While the foregoing description is directed to the preferred embodiments of the invention, other and further embodiments of the invention will be apparent to those skilled in the art and may be made without departing from the basic scope of the invention. And features described with reference to one embodiment may be combined with other embodiments, even if not explicitly stated above, without departing from the scope of the invention. The scope of the invention is defined by the claims which follow.

The invention claimed is:

1. A pack-off assembly comprising:
(a) a support element comprising:
(i) a first end,
(ii) a second end,
(iii) a tubular cavity disposed between the first and second ends,
(iv) a first port, and
(v) a second port,
(b) a side-door sleeve comprising:
(i) a piston portion disposed in the tubular cavity of the support element, and
(ii) a tubular cavity;
(c) a first actuation chamber connected to the first port;
(d) a second actuation chamber connected to the second port; and
(e) a latch that is selectively positionable to engage the side-door sleeve and thereby restrict motion of the side-door sleeve;
(f) wherein the position of the side-door sleeve is selectively variable with selective application of a pressurized fluid to at least one of the group consisting of the first actuation chamber and the second actuation chamber.

2. The pack-off assembly of claim 1 further comprising a wireline guide.

3. The pack-off assembly of claim 2 wherein the wireline guide includes a roller.

4. The pack-off assembly of claim 1 further comprising a wireline-channel pin comprising a wireline channel; wherein the wireline-channel pin is disposed partially within the tubular cavity of the support element and partially within the tubular cavity of the side-door sleeve.

5. A pack-off assembly comprising:
(a) a support element comprising:
(i) a first end,
(ii) a second end,
(iii) a tubular cavity disposed between the first and second ends,
(iv) a first port, and
(v) a second port;
(b) a side-door sleeve comprising:
(i) a piston portion disposed in the tubular cavity of the support element, and
(ii) a tubular cavity;
(c) a first actuation chamber connected to the first port;
(d) a second actuation chamber connected to the second port; and
(e) a wireline sealing element;
(f) wherein the position of the side-door sleeve is selectively variable with selective application of a pressurized fluid to at least one of the group consisting of the first actuation chamber and the second actuation chamber;
(g) wherein the wireline sealing element is within the tubular cavity of the side-door sleeve when the side-door sleeve is in a first position and the wireline sealing element is not within the tubular cavity of the side-door sleeve when the tubular side-door sleeve is in a second position.

6. The pack-off assembly of claim 5 wherein the wireline sealing element is divided into two or more separable seal sections.

7. The pack-off assembly of claim 6 further comprising a dowel pin and wherein at least two seal sections of the wireline sealing element each include a dowel-pin receiving hole and the dowel pin is disposed in the dowel-pin receiving holes.

8. The pack-off assembly of claim 5 further comprising a support bushing adjacent to the wireline sealing element wherein the support bushing is divided into two or more separable bushing sections.

9. The pack-off assembly of claim 8 further comprising a dowel pin and wherein at least two bushing sections of the support bushing each include a dowel-pin receiving hole and the dowel pin is disposed in the dowel-pin receiving holes.

10. A pack-off assembly comprising:

(a) a support element comprising:
  (i) a first end,
  (ii) a second end,
  (iii) a tubular cavity disposed between the first and second ends,
  (iv) a first port, and
  (v) a second port;

(f) a side-door sleeve comprising:
  (vi) a piston portion disposed in the tubular cavity of the support element, and
  (vii) a tubular cavity;

(b) a first actuation chamber connected to the first port;

(c) a second actuation chamber connected to the second port; and (d) a latching means for securing the side-door sleeve against repositioning;

(e) wherein the position of the side-door sleeve is selectively variable with selective application of a pressurized fluid to at least one of the group consisting of the first actuation chamber and the second actuation chamber.

11. A method of controlling pressure during wireline operations, the method comprising:

(a) providing a pack-off assembly comprising:
  (i) a side-door sleeve having a piston portion and a tubular cavity,
  (ii) a wireline sealing element configured to fit within the tubular cavity of the side-door sleeve, and
  (iii) a support element having a first port and a second port and a tubular cavity,
  (iv) wherein the piston portion of the side-door sleeve is disposed within the tubular cavity of the support element such as to define first and second actuation chambers,
  (v) wherein the first actuation chamber is connected to the first port and the second actuation chamber is connected to the second port; and (b) selectively providing a pressurized fluid to the first actuation chamber to position the side-door sleeve so that the wireline sealing element is not within the tubular cavity of the side-door sleeve; and (c) selectively providing a pressurized fluid to the second actuation chamber to position the side-door sleeve so that the wireline sealing element is within the tubular cavity of the side-door sleeve.

12. The method of claim 11 wherein the step of selectively providing the pressurized fluid to the first actuation chamber includes providing a pressurized liquid to the first actuation chamber.

13. The method of claim 11 further comprising selectively removing pressurized fluid from the second actuation chamber when selectively providing the pressurized fluid to the first actuation chamber.

14. A method of controlling pressure during wireline operations, the method comprising:

(a) providing a pack-off assembly comprising:
  (i) a side-door sleeve having a piston portion and a tubular cavity,
  (ii) a wireline sealing element configured to fit within the tubular cavity of the side-door sleeve, and
  (iii) a support element having a first port and a second port and a tubular cavity,
  (iv) wherein the piston portion of the side-door sleeve is disposed within the tubular cavity of the support element such as to define first and second actuation chambers,
  (v) wherein the first actuation chamber is connected to the first port and the second actuation chamber is connected to the second port; and (b) selectively providing a pressurized fluid to the first actuation chamber to position the side-door sleeve so that the wireline sealing element is not within the tubular cavity of the side-door sleeve; wherein the step of selectively providing the pressurized fluid to the first actuation chamber includes providing a pressurized gas to the first actuation chamber.

* * * * *